US006007503A

United States Patent [19]

Berger et al.

[11] Patent Number: 6,007,503

[45] Date of Patent: Dec. 28, 1999

[54] ACUPRESSURE DEVICE

[75] Inventors: Allen Berger, Wainscott, N.Y.; Chris Johnson, Irvine, Calif.; Drew O'Connell, Cold Spring Harbor, N.Y.

[73] Assignee: Cirrus Air Technologies LLC, Locust Valley, N.Y.

[21] Appl. No.: 09/079,214

[22] Filed: May 14, 1998

[51] Int. Cl.[6] ..... A61H 7/00; A61H 19/00

[52] U.S. Cl. ..... 601/134; 601/135; 606/204; 606/201

[58] Field of Search ..... 601/135, 136–138, 601/132–134, 118–123, 131; D24/200, 211, 214; 606/204, 201

[56] References Cited

U.S. PATENT DOCUMENTS

| | | | |
|---|---|---|---|
| D. 287,281 | 12/1986 | Lancellotti | D24/36 |
| D. 374,722 | 10/1996 | Lossing et al. | D24/211 |
| D. 384,160 | 9/1997 | Kusnets et al. | D24/215 |
| D. 403,428 | 12/1998 | Russo | D24/200 |
| 1,481,354 | 1/1924 | Dingfeld . | |
| 1,973,198 | 9/1934 | Bergmann | 83/226 |
| 2,258,931 | 10/1941 | Heer et al. | 601/126 |
| 3,297,028 | 1/1967 | Murray . | |
| 4,308,861 | 1/1982 | Kelly . | |
| 4,323,232 | 4/1982 | Terpening . | |
| 4,479,495 | 10/1984 | Isaacson . | |
| 4,590,939 | 5/1986 | Sakowski . | |
| 4,632,095 | 12/1986 | Libin . | |
| 4,716,898 | 1/1988 | Chauve et al. . | |
| 4,726,357 | 2/1988 | Destefano | 601/41 |
| 4,796,616 | 1/1989 | Panahpour | 601/135 |
| 5,263,474 | 11/1993 | Agader | 601/135 |
| 5,695,520 | 12/1997 | Bruckner et al. | 606/204 |
| 5,722,987 | 3/1998 | Witbeck | 606/201 |
| 5,788,657 | 8/1998 | Burns | 601/134 |
| 5,792,176 | 8/1998 | Chang | 606/204 |

FOREIGN PATENT DOCUMENTS

| | | |
|---|---|---|
| 2 352 539 | 12/1977 | France . |
| 26 19 410 | 11/1976 | Germany . |
| 2 089 217 | 6/1982 | United Kingdom . |

*Primary Examiner*—Richard J. Apley
*Assistant Examiner*—Justine R. Yu
*Attorney, Agent, or Firm*—Blakely, Sokoloff, Taylor & Zafman LLP

[57] ABSTRACT

An acupressure device is especially adapted for use as an anti-nausea prophylactic. The device comprises a substantially flat base having first and second opposing surfaces and a central aperture. A rounded button is disposed within the central aperture, the rounded pressure-applying surface of the button facing in the same direction as the first surface of the base. A pluraliy of spokes extend from the button to the perimeter of the central aperture, thereby supporting the button within the aperture. The first surface of the base has an adhesive coating so that the device may be adhered to the skin with the button contacting a desired acupressure point.

10 Claims, 1 Drawing Sheet

ACUPRESSURE DEVICE

BACKGROUND OF THE INVENTION

1. Field of the Invention

The present invention relates generally to a device for applying pressure to an acupuncture or acupressure point on the human body. More specifically, the present invention relates to an acupressure device for relieving nausea.

2. Background Art

The effectiveness of acupuncture and acupressure for relieving pain and for treating certain physical disorders has been known for several thousand years. In acupuncture, fine needles are inserted into the skin at specific locations on the anatomy in order to treat specific disorders. Since it is an invasive procedure, acupuncture should be administered only by a skilled practitioner. Even with normal clinical precautions, there is a danger of infection at acupuncture sites.

Due, at least in part, to the disadvantages of acupuncture, acupressure has enjoyed increasing popularity. The same anatomical locations used for acupuncture are also used for acupressure; however, only pressure is applied to the location. Pressure alone has proven to be effective for the treatment of certain disorders and for certain symptomatic relief. In particular, it has been found that pressure applied to the interior of the wrist can be effective in relieving nausea due, for example, to motion sickness.

Various devices have been developed for applying acupressure to the human body. For example, U.S. Pat. No. 4,479,495 to Isaacson and U.S. Pat. No. 4,716,898 to Chauve, et al. show acupressure devices in the form of bands that may be applied around an extremity. Chauve, et al. also disclose an acupressure device in the form of an adhesive patch.

Prior art devices in the form of bands and the like are not effective for applying acupressure to a specific location for extended periods of time. As the user moves about, the band tends to slip so that pressure is not maintained at the desired site. Furthermore, due to the constrictive effects of bands, they are uncomfortable to wear for extended periods of time. The patch design of Chauve, et al. is more effective for applying localized acupressure over an extended period of time.

SUMMARY OF THE INVENTION

The present invention provides a device for applying localized pressure on the skin of a person. It is especially adapted for use as an anti-nausea prophylactic. The device comprises a substantially flat base having first and second opposing surfaces and a central aperture. A rounded button is disposed within the central aperture, the rounded pressure-applying surface of the button facing in the same direction as the first surface of the base. A plurality of spokes extend from the button to the perimeter of the central aperture, thereby supporting the button within the aperture. The first surface of the base has an adhesive coating so that the device may be adhered to the skin with the button contacting a desired acupressure point.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
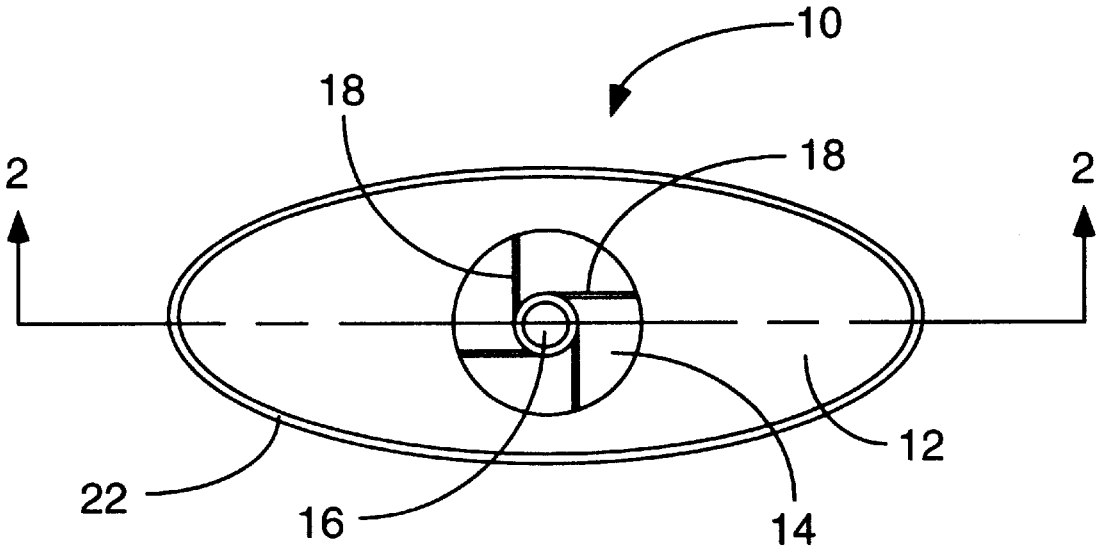
FIG. 1 is a plan view of a pressure applicator according to the present invention.

FIG. 1 is a plan view of an acupressure applicator 10 constructed in accordance with the present invention. Applicator 10 comprises a base 12 which is generally elliptical in shape. An elliptical shape is chosen so that applicator 10 can be comfortably worn on the wrist; however, other shapes may be employed. Base 12 has a central circular aperture 14, in the center of which button 16 is disposed. Button 16 is supported by spokes 18 which extend from the perimeter of button 16 to the perimeter of central aperture 14. The open area of aperture 14 between the spokes allows the user's skin to "breathe" in the vicinity of the pressure point. Applicator 10 is illustrated with four spokes 18; however, any number of spokes greater than two could be employed. Spokes 18 preferably extend tangentially from the perimeter of button 16 as shown. Spokes 18 function as a spring support for button 16. As button 16 is deflected, spokes 18 both bend and twist to provide substantially constant pressure. In this regard, the design of the present invention is superior to prior art devices.

Dimensionally, acupressure applicator 10 is preferably approximately 1.5 inches along the major axis and approximately 1.0 inches along the minor axis. Central aperture 14 is preferably approximately 0.5 inches in diameter. Button 16 is preferably approximately 0.25 inches in diameter.

Figure 2:
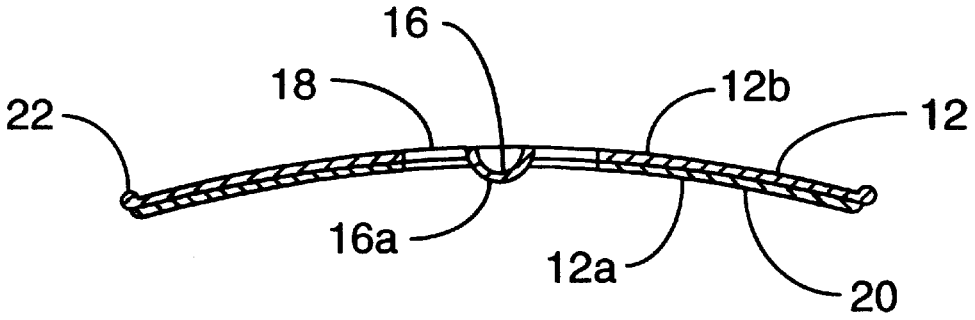
FIG. 2 is a cross-sectional view taken through line 2—2 of FIG. 1.

Referring to FIG. 2, base 12 has a proximal surface 12*a* and a distal surface 12*b*. Button 16 has a rounded pressure-applying surface 16*a* facing in the same direction as proximal surface 12*a*. In a preferred embodiment, pressure-applying surface 16*a* is generally hemispherical; however, other shapes such as conical, pyramidal, etc. may be used. Button 16 is preferably hollow as shown, although the wall thickness of the button may be varied depending upon the material used.

Proximal surface 12*a* of base 12 preferably has an adhesive coating 20 with which applicator 10 may be adhered to the skin of a user. Prior to application, adhesive 20 is preferably protected with a peel-off cover (not shown). Base 12 is preferably slightly concave along its major axis with respect to proximal surface 12*a*. Such curvature helps conform applicator 10 to the wrist of a user and thereby aids in adhesion to the skin. The preferred radius of curvature of base 12 is approximately 4 inches. Base 12 preferably includes a peripheral rib 22 on distal surface 12*b* which imparts rigidity to the base. Rib 22 is preferably approximately 0.030 inches thick.

Acupressure applicator 10 is preferably made as a unitary structure by injection molding. A preferred material is polyurethane with a durometer value of 60, although softer or harder materials may also be used. Furthermore, other injection-moldable materials may be used such as polypropylene, polyethylene, silicone or a moldable thermoplastic alloy such as Krayton™.

As indicated above, acupressure applicator 10 is particularly intended for application to the wrist as an anti-nausea prophylactic. The inherent stiffness of the device when made with the preferred material and with peripheral rib 22 allows it to be conveniently applied with one hand. The pressure applied by button 16 is preferably in the range of approximately 2–10 ounces. Owing to the relatively simple and inexpensive construction of the device, it can be worn by a person prone to motion sickness during a journey and may then be discarded.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A device for applying localized pressure on the skin of a human subject comprising:

a base having first and second opposing surfaces facing in opposite directions and a central aperture, said base having dimensions such that the entire base may be placed on the subject's wrist;

a button disposed within the central aperture, said button having a pressure-applying surface facing a direction generally the same as the direction faced by the first surface of the base; and a plurality of resilient spokes extending from the button to the base, thereby supporting the button within the aperture.

2. The device of claim 1 further comprising means for adhering the first surface of the base to the skin of the subject.

3. The device of claim 2 wherein the means for adhering the first surface of the base to the skin of the subject comprises an adhesive coating on the first surface.

4. The device of claim 1 wherein each of the plurality of spokes is substantially tangential to an outer circumference of the button.

5. The device of claim 1 wherein the pressure-applying surface is substantially hemispherical.

6. The device of claim 1 wherein the pressure-applying surface protrudes beyond the first surface.

7. The device of claim 1 wherein the base is curved concave with respect to the direction faced by the first surface.

8. The device of claim 7 wherein the base is generally elliptical and is curved along a major elliptical axis.

9. The device of claim 7 wherein the base is semi-rigid.

10. The device of claim 1 wherein the base includes a rib around an outer perimeter of the base.

* * * * *